US012193499B2

(12) United States Patent
Moloney et al.

(10) Patent No.: US 12,193,499 B2
(45) Date of Patent: Jan. 14, 2025

(54) POROUS ELEMENT FOR A VAPOR PROVISION SYSTEM

(71) Applicant: Nicoventures Trading Limited, London (GB)

(72) Inventors: Patrick Moloney, London (GB); Catalin Mihai Balan, London (GB)

(73) Assignee: NICOVENTURES TRADING LIMITED, London (GB)

( * ) Notice: Subject to any disclaimer, the term of this patent is extended or adjusted under 35 U.S.C. 154(b) by 412 days.

(21) Appl. No.: 17/597,721

(22) PCT Filed: Jul. 21, 2020

(86) PCT No.: PCT/GB2020/051736
§ 371 (c)(1),
(2) Date: Jan. 20, 2022

(87) PCT Pub. No.: WO2021/014139
PCT Pub. Date: Jan. 28, 2021

(65) Prior Publication Data

US 2022/0369711 A1 Nov. 24, 2022

(30) Foreign Application Priority Data

Jul. 23, 2019 (GB) ..... 1910509

(51) Int. Cl.
*A24F 47/00* (2020.01)
*A24F 40/44* (2020.01)
*A24F 40/46* (2020.01)

(52) U.S. Cl.
CPC ..... *A24F 40/44* (2020.01); *A24F 40/46* (2020.01)

(58) Field of Classification Search
CPC ..... A24F 40/44; A24F 40/46
See application file for complete search history.

(56) References Cited

U.S. PATENT DOCUMENTS

| | | | | |
|---|---|---|---|---|
| 5,665,262 | A * | 9/1997 | Hajaligol | A24F 40/46 131/194 |
| 9,980,512 | B2 | 5/2018 | Collett et al. | |
| 10,004,259 | B2 | 6/2018 | Sebastian et al. | |
| 10,729,181 | B2 * | 8/2020 | Zinovik | A24F 40/44 |
| 2006/0196518 | A1 | 9/2006 | Hon | |

(Continued)

FOREIGN PATENT DOCUMENTS

| | | |
|---|---|---|
| CN | 103237470 A | 8/2013 |
| CN | 104254356 A | 12/2014 |

(Continued)

OTHER PUBLICATIONS

PCT Search Report and Written Opinion Corresponding to PCT/GB2020/051736, dated Jan. 28, 2021.

(Continued)

*Primary Examiner* — Neil Abrams
(74) *Attorney, Agent, or Firm* — Husch Blackwell

(57) ABSTRACT

A porous element for a vapor provision system includes an elongate rod of porous ceramic material having a first end face, a second end face, and one or more side faces extending between the first end face and the second end face and defining a length of the rod; and a coating of metal applied to at least one side face over at least part of the length of the rod.

27 Claims, 6 Drawing Sheets

(56) References Cited

U.S. PATENT DOCUMENTS

| | | | | |
|---|---|---|---|---|
| 2013/0213418 | A1* | 8/2013 | Tucker | A24F 40/42 131/328 |
| 2013/0298905 | A1 | 11/2013 | Levin | |
| 2014/0261488 | A1 | 9/2014 | Tucker | |
| 2014/0261492 | A1 | 9/2014 | Kane | |
| 2015/0053668 | A1 | 2/2015 | Decker et al. | |
| 2017/0055574 | A1* | 3/2017 | Kaufman | A24B 15/12 |
| 2017/0202266 | A1 | 7/2017 | Sur | |
| 2018/0168225 | A1 | 6/2018 | Zinovik et al. | |
| 2019/0053539 | A1 | 2/2019 | Davis et al. | |
| 2019/0098935 | A1 | 4/2019 | Phan et al. | |
| 2019/0191782 | A1* | 6/2019 | Tang | A24F 40/48 |
| 2019/0216132 | A1 | 7/2019 | Phan et al. | |
| 2019/0281892 | A1* | 9/2019 | Hejazi | A24F 40/465 |
| 2020/0060341 | A1* | 2/2020 | Sebastian | A24F 40/44 |
| 2020/0093182 | A1* | 3/2020 | Monsalud | A61M 15/0003 |
| 2022/0202090 | A1* | 6/2022 | Moloney | A24F 40/44 |
| 2022/0369711 | A1* | 11/2022 | Moloney | A24F 40/44 |

FOREIGN PATENT DOCUMENTS

| | | | |
|---|---|---|---|
| CN | 105307520 | A | 2/2016 |
| CN | 106455713 | A | 2/2017 |
| CN | 109068735 | A | 12/2018 |
| JP | 2006524494 | A | 11/2006 |
| JP | 2015511128 | A | 4/2015 |
| JP | 2017515490 | A | 6/2017 |
| KR | 20140135750 | A | 11/2014 |
| RU | 2615960 | C2 | 4/2017 |
| RU | 2661461 | C2 | 7/2018 |
| RU | 2680438 | C2 | 2/2019 |
| WO | 2018018599 | A1 | 2/2018 |
| WO | 2018055558 | A1 | 3/2018 |
| WO | 2018211035 | A1 | 11/2018 |

OTHER PUBLICATIONS

"International Preliminary Report on Patentability for Application No. PCT/GB2020/051736, mailed on Oct. 28, 2021", 6 pages.

"Office Action received for Chinese Patent Application No. 202080044238.0, mailed on Jun. 4, 2024", 18 pages (9 pages of English Translation and 9 pages of Official Copy).

"Office Action received for Korean Patent Application No. 10-2022-7002166, mailed on Jun. 17, 2024", 13 pages (7 pages of English Translation and 6 pages of Official Copy).

"Office Action received for Russian Patent Application No. 2022101249, mailed on Jun. 17, 2022", 2 pages.

"Reasons for Rejection received for Japanese Patent Application No. 2021574297, mailed on Apr. 4, 2023", 11 pages (5 pages of English Translation and 6 pages of Official Copy Only).

"Search Report received for Japanese Patent Application No. 2021574297, mailed on Mar. 29, 2023", 29 pages (15 pages of English Translation and 14 pages of Official Copy Only).

* cited by examiner

POROUS ELEMENT FOR A VAPOR PROVISION SYSTEM

PRIORITY CLAIM

The present application is a National Phase entry of PCT Application No. PCT/EP2020/067558, filed Jun. 23, 2020, which claims priority from European Application No. 1909338.4, filed Jun. 28, 2019, each of which is hereby fully incorporated herein by reference.

TECHNICAL FIELD

The present disclosure relates to a porous element for a vapor provision system, and an aerosol source, a cartomizer or a cartridge and a vapor provision system comprising such a porous element.

BACKGROUND

Many electronic vapor provision systems, such as e-cigarettes and other electronic nicotine delivery systems that deliver nicotine via vaporized liquids, are formed from two main components or sections, namely a cartridge or cartomizer section and a control unit (battery section). The cartomizer generally includes a reservoir of liquid and an atomizer for vaporizing the liquid. These parts may collectively be designated as an aerosol source. The generally combines the functions of porosity or wicking and heating in order to transport liquid from the reservoir to a location where it is heated and vaporized. For example, it may be implemented as an electrical heater, which may be a resistive wire formed into a coil or other shape for resistive (Joule) heating or a susceptor for induction heating, and a porous element such as a fibrous wick with capillary or wicking capability in proximity to the heater which absorbs liquid from the reservoir and carries it to the heater. The control unit generally includes a battery for supplying power to operate the system. Electrical power from the battery is delivered to activate the heater, which heats up to vaporize a small amount of liquid delivered from the reservoir. The vaporized liquid is then inhaled by the user.

Alternative designs for elements suitable for use as atomizers are of interest.

SUMMARY

According to a first aspect of some embodiments described herein, there is provided a porous element for a vapor provision system, comprising: an elongate rod of porous ceramic material having a first end face, a second end face, and one or more side faces extending between the first end face and the second end face and defining a length of the rod; and a coating of metal applied to at least one side face over at least part of the length of the rod.

According to a second aspect of some embodiments described herein, there is provided an aerosol source for a vapor provision system comprising a porous element according to the first aspect, and a reservoir for holding aerosolizable substrate material to be delivered to the porous element for vaporization.

According to a third aspect of some embodiments described herein, there is provide a cartomizer for a vapor provision system comprising a porous element according to the first aspect or an aerosol source according to the second aspect. According to a fourth aspect of some embodiments described herein, there is provided vapor provision system comprising a porous element according to the first aspect, an aerosol source according to the second aspect, or a cartomizer according to the third aspect.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, a porous element or an aerosol source, a cartomizer or a vapor provision system including a porous element may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which.

DETAILED DESCRIPTION

Figure 1:
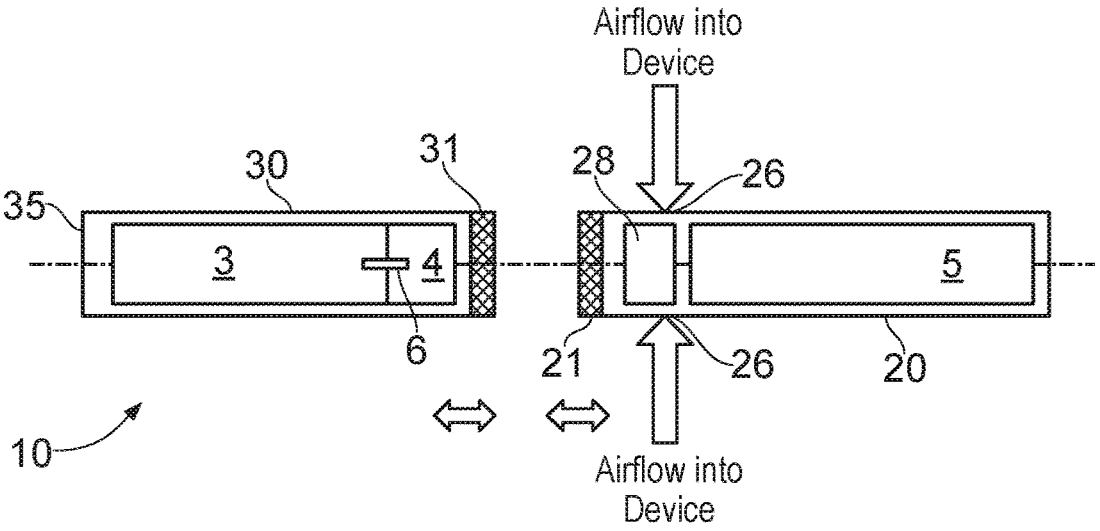
FIG. 1 shows a cross-section through an example e-cigarette comprising a cartomizer and a control unit.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. The systems are intended to generate an inhalable aerosol by vaporization of a substrate in the form of a liquid or gel which may or may not contain nicotine. Additionally, hybrid systems may comprise a liquid or gel substrate plus a solid substrate which is also heated. The solid substrate may be for example tobacco or other non-tobacco products, which may or may not contain nicotine. The term "aerosolizable substrate material" as used herein is intended to refer to substrate materials which can form an aerosol, either through the application of heat or some other means. The term "aerosol" may be used interchangeably with "vapor".

As used herein, the term "component" is used to refer to a part, section, unit, module, assembly or similar of an electronic cigarette or similar device that incorporates several smaller parts or elements, possibly within an exterior housing or wall. An electronic cigarette may be formed or built from one or more such components, and the components may be removably or separably connectable to one another, or may be permanently joined together during manufacture to define the whole electronic cigarette. The present disclosure is applicable to (but not limited to) systems comprising two components separably connectable to one another and configured, for example, as an aerosolizable substrate material carrying component holding liquid or another aerosolizable substrate material (a cartridge, cartomizer or consumable), and a control unit having a battery for providing electrical power to operate an element for generating vapor from the substrate material. For the sake of providing a concrete example, in the present disclosure, a cartomizer is described as an example of the aerosolizable substrate material carrying portion or component, but the disclosure is not limited in this regard and is applicable to any configuration of aerosolizable substrate material carrying portion or component. Also, such a component may include more or fewer parts than those included in the examples.

The present disclosure is particularly concerned with vapor provision systems and components thereof that utilize aerosolizable substrate material in the form of a liquid or a gel which is held in a reservoir, tank, container or other receptacle comprised in the system.

An arrangement for delivering the substrate material from the reservoir for the purpose of providing it for vapor/aerosol generation is included. The terms "liquid", "gel", "fluid", "source liquid", "source gel", "source fluid" and the like may be used interchangeably with "aerosolizable substrate material" and "substrate material" to refer to aerosolizable substrate material that has a form capable of being stored and delivered in accordance with examples of the present disclosure.

FIG. 1 is a highly schematic diagram (not to scale) of a generic example aerosol/vapor provision system such as an e-cigarette 10, presented for the purpose of showing the relationship between the various parts of a typical system and explaining the general principles of operation. The e-cigarette 10 has a generally elongate shape in this example, extending along a longitudinal axis indicated by a dashed line, and comprises two main components, namely a control or power component, section or unit 20, and a cartridge assembly or section 30 (sometimes referred to as a cartomizer or clearomizer) carrying aerosolizable substrate material and operating as a vapor-generating component.

The cartomizer 30 includes a reservoir 3 containing a source liquid or other aerosolizable substrate material comprising a formulation such as liquid or gel from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated), such as a portion of tobacco or other flavor element through which vapor generated from the liquid is passed, may also be included. The reservoir 3 has the form of a storage tank, being a container or receptacle in which source liquid can be stored such that the liquid is free to move and flow within the confines of the tank. For a consumable cartomizer, the reservoir 3 may be sealed after filling during manufacture so as to be disposable after the source liquid is consumed, otherwise, it may have an inlet port or other opening through which new source liquid can be added by the user. The cartomizer 30 also comprises an electrically powered heating element or heater 4 located externally of the reservoir tank 3 for generating the aerosol by vaporization of the source liquid by heating. A liquid transfer or delivery arrangement (liquid transport element) such as a wick or other porous element 6 may be provided to deliver source liquid from the reservoir 3 to the heater 4. A wick 6 may have one or more parts located inside the reservoir 3, or otherwise be in fluid communication with the liquid in the reservoir 3, so as to be able to absorb source liquid and transfer it by wicking or capillary action to other parts of the wick 6 that are adjacent or in contact with the heater 4. This liquid is thereby heated and vaporized, to be replaced by new source liquid from the reservoir for transfer to the heater 4 by the wick 6. The wick may be thought of as a bridge, path or conduit between the reservoir 3 and the heater 4 that delivers or transfers liquid from the reservoir to the heater. Terms including conduit, liquid conduit, liquid transfer path, liquid delivery path, liquid transfer mechanism or element, and liquid delivery mechanism or element may all be used interchangeably herein to refer to a wick or corresponding component or structure.

A heater and wick (or similar) combination is sometimes referred to as an atomizer or atomizer assembly, and the reservoir with its source liquid plus the atomizer may be collectively referred to as an aerosol source. Other terminology may include a liquid delivery assembly or a liquid transfer assembly, where in the present context these terms may be used interchangeably to refer to a vapor-generating element (vapor generator) plus a wicking or similar component or structure (liquid transport element) that delivers or transfers liquid obtained from a reservoir to the vapor generator for vapor/aerosol generation. Various designs are possible, in which the parts may be differently arranged compared with the highly schematic representation of FIG. 1. For example, the wick 6 may be an entirely separate element from the heater 4, or the heater 4 may be configured to be porous and able to perform at least part of the wicking function directly (a metallic mesh, for example).

In an electrical or electronic device, the vapor generating element may be an electrical heating element that operates by ohmic/resistive (Joule) heating or by inductive heating. In general, therefore, an atomizer can be considered as one or more elements that implement the functionality of a vapor-generating or vaporizing element able to generate vapor from source liquid delivered to it, and a liquid transport or delivery element able to deliver or transport liquid from a reservoir or similar liquid store to the vapor generator by a wicking action/capillary force. An atomizer is typically housed in a cartomizer component of a vapor generating system. In some designs, liquid may be dispensed from a reservoir directly onto a vapor generator with no need for a distinct wicking or capillary element. Embodiments of the disclosure are applicable to all and any such configurations which are consistent with the examples and description herein.

Returning to FIG. 1, the cartomizer 30 also includes a mouthpiece or mouthpiece portion 35 having an opening or air outlet through which a user may inhale the aerosol generated by the atomizer 4.

The power component or control unit 20 includes a cell or battery (referred to herein after as a battery, and which may be re-chargeable) to provide power for electrical components of the e-cigarette 10, in particular to operate the heater 4. Additionally, there is a controller 28 such as a printed circuit board and/or other electronics or circuitry for generally controlling the e-cigarette. The control electronics/circuitry 28 operates the heater 4 using power from the battery 5 when vapor is required, for example in response to a signal from an air pressure sensor or air flow sensor (not shown) that detects an inhalation on the system 10 during which air enters through one or more air inlets 26 in the wall of the control unit 20. When the heating element 4 is operated, the heating element 4 vaporizes source liquid delivered from the reservoir 3 by the liquid delivery element 6 to generate the aerosol, and this is then inhaled by a user through the opening in the mouthpiece 35. The aerosol is carried from the aerosol source to the mouthpiece 35 along one or more air channels (not shown) that connect the air inlet 26 to the aerosol source to the air outlet when a user inhales on the mouthpiece 35.

The control unit (power section) 20 and the cartomizer (cartridge assembly) 30 are separate connectable parts detachable from one another by separation in a direction parallel to the longitudinal axis, as indicated by the solid arrows in FIG. 1. The components 20, 30 are joined together when the device 10 is in use by cooperating engagement elements 21, 31 (for example, a screw or bayonet fitting) which provide mechanical and in some cases electrical connectivity between the power section 20 and the cartridge assembly 30. Electrical connectivity is required if the heater 4 operates by ohmic heating, so that current can be passed through the heater 4 when it is connected to the battery 5. In systems that use inductive heating, electrical connectivity can be omitted if no parts requiring electrical power are located in the cartomizer 30. An inductive work coil can be housed in the power section 20 and supplied with power from the battery 5, and the cartomizer 30 and the power section 20 shaped so that when they are connected, there is an appropriate exposure of the heater 4 to flux generated by the coil for the purpose of generating current flow in the material of the heater. Inductive heating arrangements are discussed further below. The FIG. 1 design is merely an example arrangement, and the various parts and features may be differently distributed between the power section 20 and the cartridge assembly section 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. In other examples, the system 10 may be unitary, in that the parts of the control unit 20 and the cartomizer 30 are comprised in a single housing and cannot be separated. Embodiments and examples of the present disclosure are applicable to any of these configurations and other configurations of which the skilled person will be aware.

Figure 2:
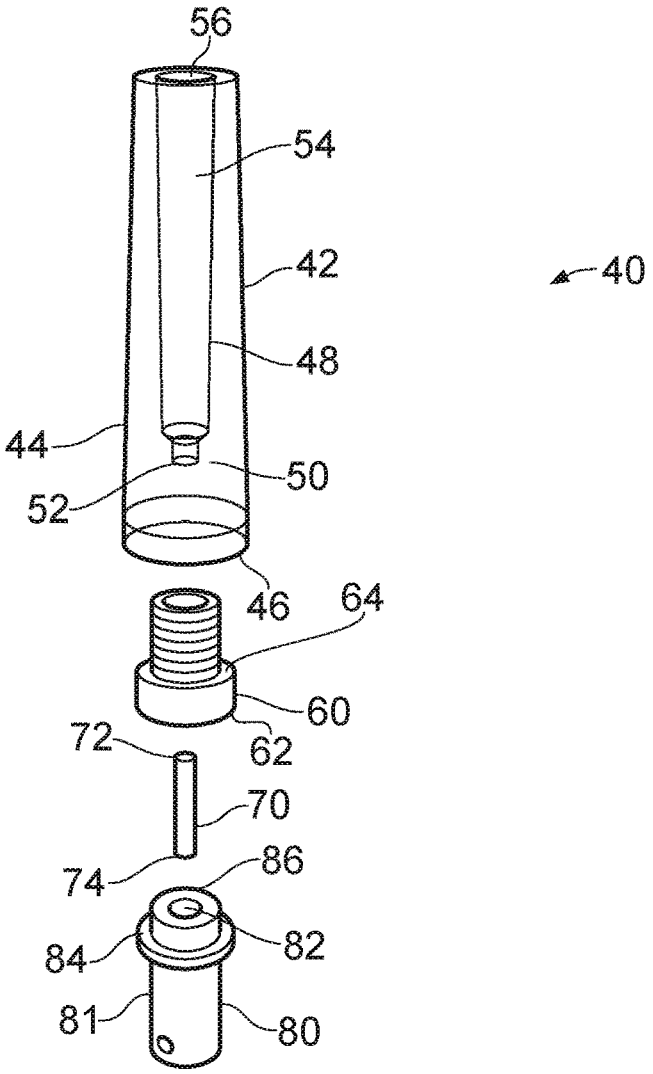
FIG. 2 shows an external perspective exploded view of an example cartomizer in which aspects of the disclosure can be implemented.

FIG. 2 shows an external perspective view of parts which can be assembled to form a cartomizer according to an example of the present disclosure. The cartomizer 40 comprises four parts only, which can be assembled by being pushed or pressed together if appropriately shaped. Hence, fabrication can be made very simple and straightforward.

A first part is a housing 42 that defines a reservoir for holding aerosolizable substrate material (hereinafter referred to as a liquid, for brevity). The housing 42 has a generally tubular shape, which in this example has a circular cross-section, and comprises a wall or walls shaped to define various parts of the reservoir and other items. A cylindrical outer side wall 44 is open at its lower end at an opening 46 through which the reservoir may be filled with liquid, and to which parts can be joined as described below. This defines an exterior or external volume or dimensions of the reservoir. References herein to elements or parts lying or being located externally to the reservoir are intended to indicate that the part is outside or partially outside the region bounded or defined by this outer wall 44.

A cylindrical inner wall 48 is concentrically arranged within the outer side wall 44.

This arrangement defines an annular volume 50 between the outer wall 44 and the inner wall 48 which is a receptacle, cavity, void or similar to hold liquid, in other words, the reservoir. The outer wall 44 and the inner wall 48 are connected together (for example by a top wall or by the walls tapering towards one another) in order to close the upper edge of the reservoir volume 50. The inner wall 48 is open at its lower end at an opening 52, and also at its upper end. The tubular inner space bounded by the inner wall is an air flow passage or channel 54 that, in the assembled system, carries generated aerosol from an atomizer to a mouthpiece outlet of the system for inhalation by a user. The opening 56 at the upper end of the inner wall 48 can be the mouthpiece outlet, configured to be comfortably received in the user's mouth, or a separate mouthpiece part can be coupled on or around the housing 42 having a channel connecting the opening 56 to a mouthpiece outlet.

The housing 42 may be formed from molded plastic material, for example by injection molding. In the example of FIG. 2, it is formed from transparent material; this allows the user to observe a level or amount of liquid in the reservoir 44. The housing might alternatively be opaque, or opaque with a transparent window through which the liquid level can be seen. The plastic material may be rigid in some examples.

A second part of the cartomizer 40 is a flow directing member 60, which in this example also has a circular cross-section, and is shaped and configured for engagement with the lower end of the housing 42. The flow directing member 60 is effectively a bung, and is configured to provide a plurality of functions. When inserted into the lower end of the housing 42, it couples with the opening 46 to close and seal the reservoir volume 50 and couples with the opening 52 to seal off the air flow passage 54 from the reservoir volume 50.

Additionally, the flow directing member 60 has at least one channel passing through it for liquid flow, which carries liquid from the reservoir volume 50 to a space external to the reservoir which acts as an aerosol chamber where vapor/aerosol is generated by heating the liquid. Also the flow directing member 60 has at least one other channel passing through it for aerosol flow, which carries the generated aerosol from the aerosol chamber space to the air flow passage 54 in the housing 42, so that it is delivered to the mouthpiece opening for inhalation.

Also, the flow directing member 60 may be made from a flexible resilient material such as silicone so that it can be easily engaged with the housing 46 via a friction fit. Additionally, the flow directing member has a socket or similarly-shaped formation (not shown) on its lower surface 62, opposite to the upper surface or surfaces 64 which engages with the housing 42. The socket receives and supports an atomizer 70, being a third part of the cartomizer 40.

The atomizer 70 has an elongate shape with a first end 72 and a second end 74 oppositely disposed with respect to its elongate length. In the assembled cartomizer, the atomizer is mounted at its first end 72 which is pushed into the socket of the flow directing member 60 in a direction towards the reservoir housing 42. The first end 72 is therefore supported by the flow directing member 60, and the atomizer 70 extends lengthwise outwardly from the reservoir substantially along the longitudinal axis defined by the concentrically shaped parts of the housing 42. The second end 74 of the atomizer 70 is not mounted, and is left free. Accordingly, the atomizer 70 is supported in a cantilevered manner extending outwardly from the exterior bounds of the reservoir. The atomizer 70 performs a wicking function and a heating function in order to generate aerosol, and comprises an electrically resistive heater portion configured to act as an inductive susceptor, and a porous portion configured to wick liquid from the reservoir to the vicinity of the heater. Examples of the atomizer 70 are described in more detail below.

A fourth part of the cartomizer 40 is an enclosure or shroud 80. Again, this has a circular cross-section in this example. It comprises a cylindrical side wall 81 closed by a an optional base wall to define a central hollow space or void 82. The upper rim 84 of the side wall 81, around an opening 86, is shaped to enable engagement of the enclosure 80 with reciprocally shaped parts on the flow directing member 60 so that the enclosure 80 can be coupled to the flow directing member 60 once the atomizer 70 is fitted into the socket on the flow directing member 60. The flow directing member 60 hence acts as a cover to close the central space 82, and this space 82 creates an aerosol chamber in which the atomizer 70 is disposed. The opening 86 allows communication with the liquid flow channel and the aerosol flow channel in the flow directing member 60 so that liquid can be delivered to the atomizer and generated aerosol can be removed from the aerosol chamber. In order to enable a flow of air through the aerosol chamber to pass over the atomizer 70 and collect the vapor such that it becomes entrained in the air flow to form an aerosol, the wall or walls 81 of the enclosure 80 have one or more openings or perforations to allow air to be drawn into the aerosol chamber when a user inhales via the mouthpiece opening of the cartomizer.

The enclosure 80 may be formed from plastics material, such as by injection molding. It may be formed from a rigid material, and can then be readily engaged with the flow directing member by pushing or pressing the two parts together.

As noted above, the flow directing member can be made from a flexible resilient material, and may hold the parts coupled to it, namely the housing 42, the atomizer 70 and the enclosure 80, by friction fit. Since these parts may be more rigid, the flexibility of the flow directing member, which enables it to deform somewhat when pressed against these other parts, accommodates any minor errors in the manufactured size of the parts. In this way, the flow directing part can absorb manufacturing tolerances of all the parts while still enabling quality assembly of the parts altogether to form the cartomizer 40. Manufacturing requirements for making the housing 42, the atomizer 70 and the enclosure 80 can therefore be relaxed somewhat, reducing manufacturing costs.

Figure 3:
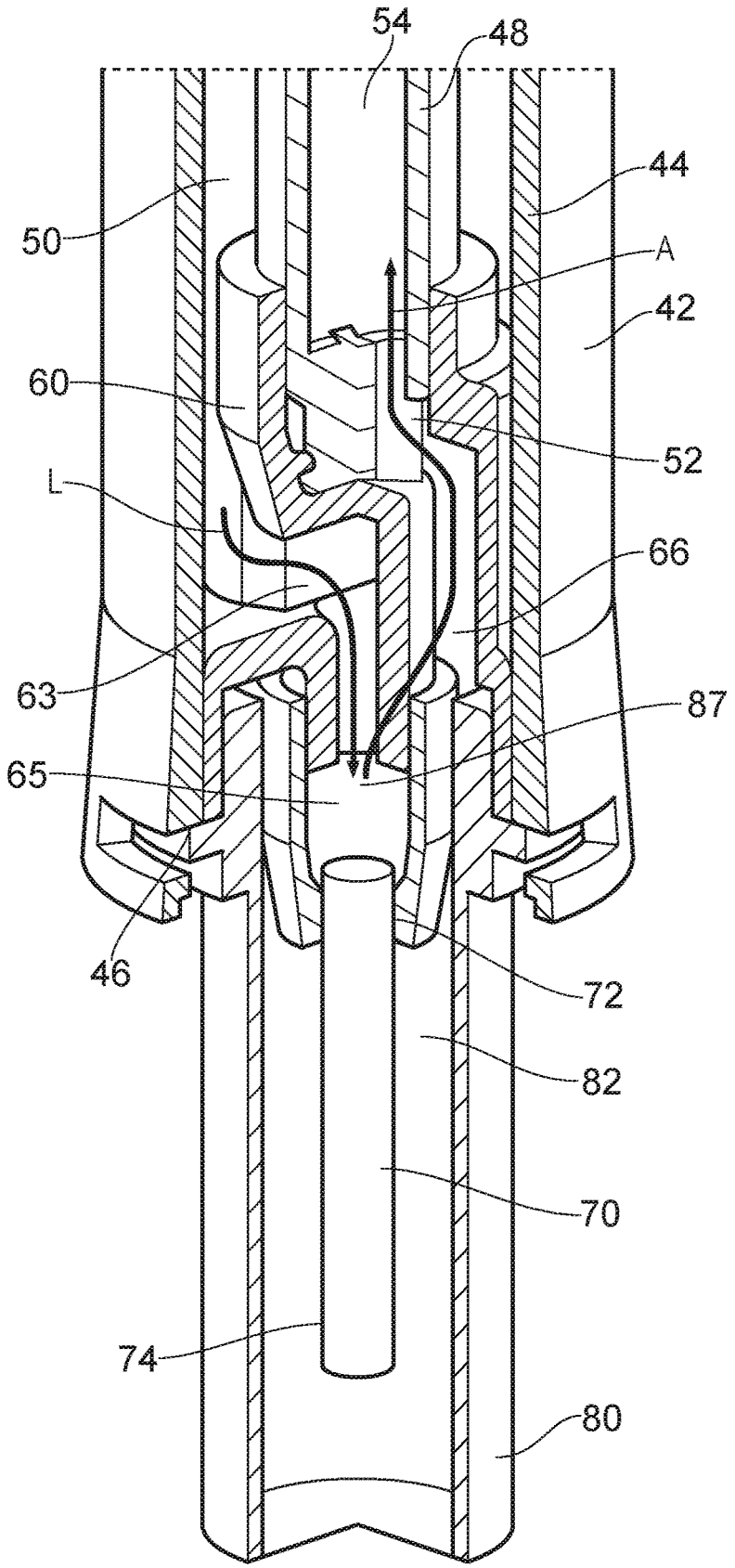
FIG. 3 shows a partially cut-away perspective view of the cartomizer of FIG. 2 in an assembled arrangement.

FIG. 3 shows a cut-away perspective view of the cartomizer of FIG. 1 in an assembled configuration. For clarity, the flow directing member 60 is shaded. It can be seen how the flow directing member 60 is shaped on its upper surfaces to engage around the opening 52 defined by the lower edge of the inner wall 48 of the reservoir housing 42, and concentrically outwardly to engage in the opening 46 defined by the lower edge of the outer wall 44 of the housing 42, in order to seal both reservoir space 50 and the air flow passage 54.

The flow directing member 60 has a liquid flow channel 63 which allows the flow of liquid L from the reservoir volume 50 through the flow directing member into a space or volume 65 under the flow directing member 60. Also, there is an aerosol flow channel 66 which allows the flow of aerosol and air A from the space 65 through the flow directing member 60 to the air flow passage 54.

The enclosure 80 is shaped at its upper rim to engage with corresponding shaped parts in the lower surface of the flow directing member 60, to create the aerosol chamber 82 substantially outside the exterior dimensions of the volume of the reservoir 50 according to the reservoir housing 42. In this example, the enclosure 80 has an aperture 87 in its upper end proximate the flow directing member 60. This coincides with the space 65 with which the liquid flow channel 63 and the aerosol flow channel 66 communicate, and hence allows liquid to enter the aerosol chamber 82 and aerosol to leave the aerosol chamber 82 via the channels in the flow directing member 60.

In this example, the aperture 87 also acts as a socket for mounting the first, supported, end 72 of the atomizer 70 (recall that in the FIG. 2 description, the atomizer socket was mentioned as being formed in the flow directing member;

either option can be used). Thus, liquid arriving through the liquid flow channel 63 is fed directly to the first end 72 of the atomizer 70 for absorption and wicking, and air/aerosol can be drawn over and past the atomizer 70 to enter the aerosol flow channel 66. The second end 74 of the atomizer 70 is remote from the reservoir space 50 and unsupported within the aerosol chamber 82. The atomizer 70 is therefore supported in a cantilevered arrangement.

The atomizer 70 is formed from a porous rod-shaped element that acts as the wicking component of the atomizer 70. In this example the rod is cylindrical. A metallic coating (not shown in FIG. 3) is applied to one or more surfaces of at least a lower portion of the atomizer, proximate the second end 74 and located in the aerosol chamber 82. This acts as the heater component of the atomizer 70, by being a susceptor for induction heating. Liquid arriving in the space 65 is collected by the absorbency of the porous material of the atomizer 70 and carried downwards to the heater component. Heating via induction is described further below.

The example of FIGS. 2 and 3 has parts with substantially circular symmetry in a plane orthogonal to the longitudinal dimension of the assembled cartomizer. Hence, the parts are free from any required orientation in the planes in which they are joined together, which can give ease of manufacture. The parts can be assembled together in any orientation about the axis of the longitudinal dimension, so there is no requirement to place the parts in a particular orientation before assembly. This is not essential, however, and the parts maybe alternatively shaped.

Figure 4:
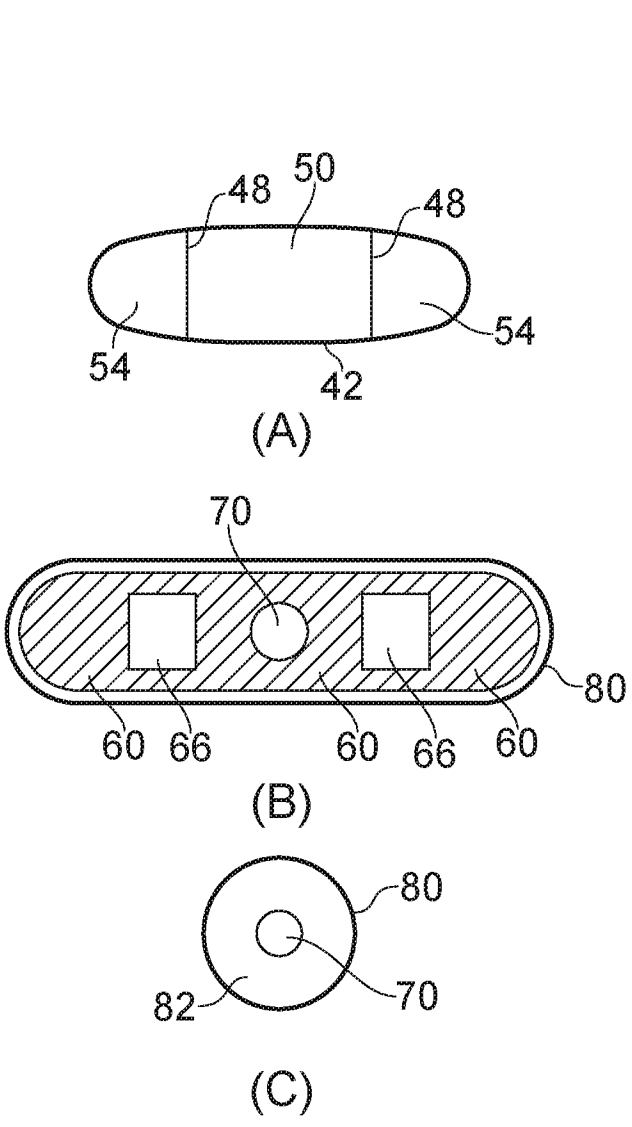
FIG. 4 shows a simplified schematic cross-sectional view of a further example cartomizer in which aspects of the disclosure can be implemented.
Figure 4:
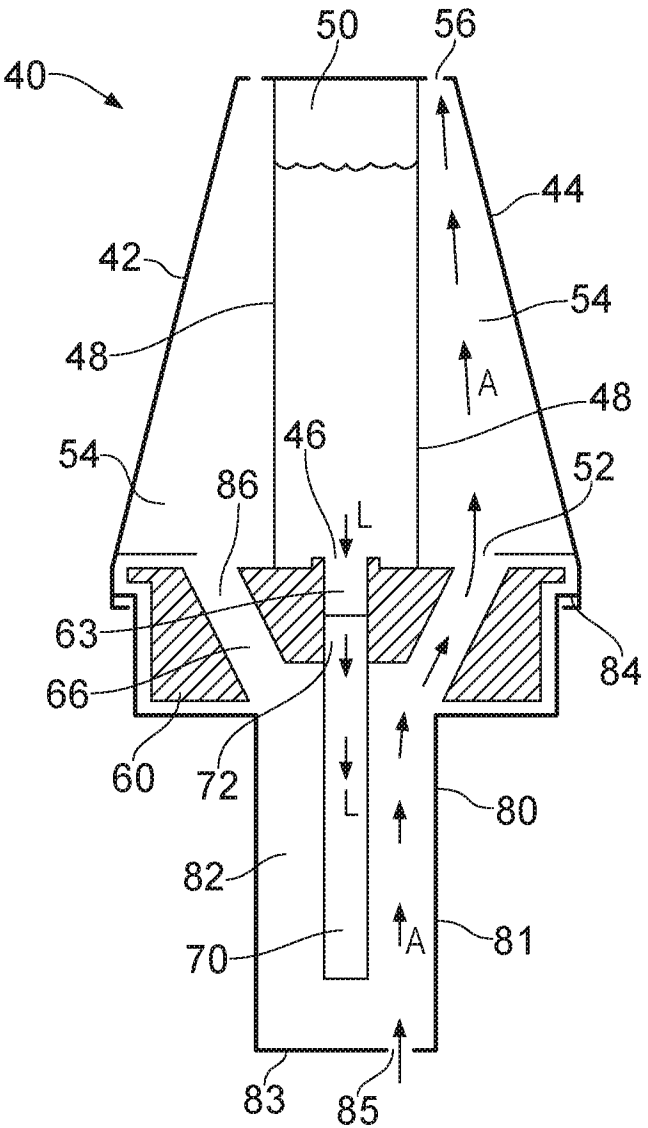

FIG. 4 shows a cross-sectional view through a further example assembled cartomizer comprising a reservoir housing, a flow directing member, an atomizer and a enclosure, as before. In this example, though, in the plane orthogonal to the longitudinal axis of the cartomizer 40, at least some of the parts have an oval shape instead of a circular shape, and are arranged to have symmetry along the major axis and the minor axis of the oval. Features are reflected on either side of the major axis and on either side of the minor axis. This means that for assembly the parts can have either of two orientations, rotated from each other by 180° about the longitudinal axis. Again, assembly is simplified compared to a system comprising parts with no symmetry.

In this example, the enclosure 80 again comprises a side wall 81, which is formed so as to have a varying cross-section at different points along the longitudinal cross axis of the enclosure, and a base wall 83, which bound a space that creates the aerosol chamber 82. Towards its upper end, the enclosure broadens out to a large cross-section to give room to accommodate the flow directing member 60. The large cross-section portion of the enclosure 80 has a generally oval cross-section (see FIG. 4(8)), while the narrower cross-section portion of the enclosure has a generally circular cross-section (see FIG. 4(C)). The enclosure's upper rim 84, around the top opening 86, is shaped to engage with corresponding shaping on the reservoir housing 42. This shaping and engagement is shown in simplified form in FIG. 4; in reality it is likely to be more complex in order to provide a reasonably air-tight and liquid-tight join. The enclosure 80 has at least one opening 85, in this case in the base wall 83, to allow air to enter the aerosol chamber during user inhalation. The reservoir housing 42 is differently shaped compared with the FIGS. 2 and 3 example. The outer wall 44 defines an interior space which is divided into three regions by two inner walls 48. The regions are arranged side by side. The central region, between the two inner walls 48 is the reservoir volume 50 for holding liquid. This region is closed at the top by a top wall of the housing. An opening 46 in the base of the reservoir volume allows liquid to be delivered from the reservoir 50 to the aerosol chamber 82. The two side regions, between the outer wall 44 and the inner walls 48, are the air flow passages 54. Each has an opening 52 at its lower end for aerosol to enter, and a mouthpiece opening 56 at its upper end (as before, a separate mouthpiece portion might be added externally to the reservoir housing 42).

A flow directing member 60 (shaded for clarity) is engaged into the lower edge of the housing 42, via shaped portions to engage with the openings 46 and 52 in the housing 42 to close/seal the reservoir volume 50 and the air flow passages 54. The flow directing member 60 has a single centrally disposed liquid flow channel 63 aligned with the reservoir volume opening 46 to transport liquid L from the reservoir to the aerosol chamber 82. Further, there are two aerosol flow channels 66, each running from an inlet at the aerosol chamber 82 to an outlet to the air flow passages 54, by which air entering the aerosol chamber through the hole 83 and collecting vapor in the aerosol chamber 82 flows into the air flow passages 54 to the mouthpiece outlets 56.

The atomizer 70 is mounted by insertion of its first end 72 into the liquid flow channel 63 of the flow directing component 60. Hence, in this example, the liquid flow channel 63 acts as a socket for the cantilevered mounting of the atomizer 70. The first end 72 of the atomizer 70 is thus directly fed with liquid entering the liquid flow channel 60 from the reservoir 50, and the liquid is taken up via the porous properties of the atomizer 70 and drawn along the atomizer length to be heated by the heater portion of the atomizer 70 (not shown) which is located in the aerosol chamber 82.

FIGS. 4(A), (B) and (C) show cross-sections through the cartomizer 40 at the corresponding positions along the longitudinal axis of the cartomizer 40.

While aspects of the disclosure are relevant to atomizers in which the heating aspect is implemented via resistive heating, which requires electrical connections to be made to a heating element for the passage of current, the design of the cartomizer has particular relevance to the use of induction heating. This is a process by which an electrically conducting item, typically made from metal, is heated by electromagnetic induction via eddy currents flowing in the item which generates heat. An induction coil (working coil) operates as an electromagnet when a high-frequency alternating current from an oscillator is passed through it; this produces a magnetic field. When the conducting item is placed in the flux of the magnetic field, the field penetrates the item and induces electric eddy currents. These flow in the item, and generate heat according to current flow against the electrical resistance of the item via Joule heating, in the same manner as heat is produced in a resistive electrical heating element by the direct supply of current. An attractive feature of induction heating is that no electrical connection to the conducting item is needed; the requirement instead is that a sufficient magnetic flux density is created in the region occupied by the item. In the context of vapor provision systems, where heat generation is required in the vicinity of liquid, this is beneficial since a more effective separation of liquid and electrical current can be effected. Assuming no other electrically powered items are placed in a cartomizer, there is no need for any electrical connection between a cartomizer and its power section, and a more effective liquid barrier can be provided by the cartomizer wall, reducing the likelihood of leakage.

Induction heating is effective for the direct heating of an electrically conductive item, as described above, but can also be used to indirectly heat non-conducting items. In a vapor provision system, the need is to provide heat to liquid in the porous wicking part of the atomizer in order to cause vaporization. For indirect heating via induction, the electrically conducting item is placed adjacent to or in contact with the item in which heating is required, and between the work coil and the item to be heated. The work coil heats the conducting item directly by induction heating, and heat is transferred by thermal radiation or thermal conduction to the non-conducting item. In this arrangement, the conducting item is termed a susceptor. Hence, in an atomizer, the heating component can be provided by an electrically conductive material (typically metal as in the examples herein) which is used as an induction susceptor to transfer heat energy to a porous part of the atomizer.

Figure 5:
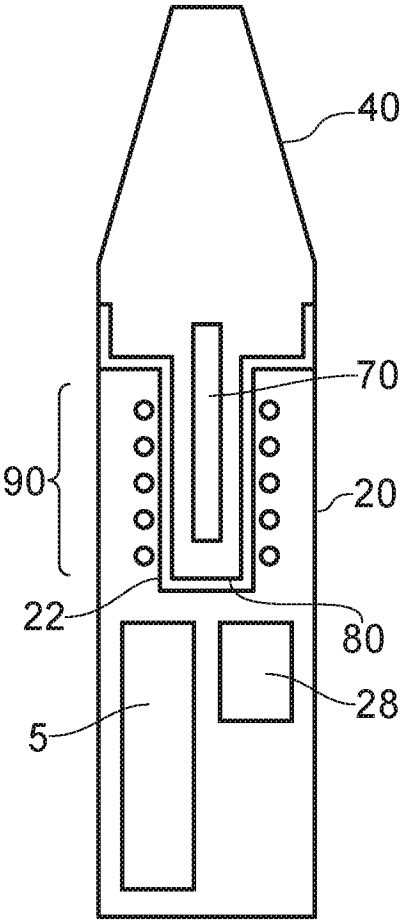
FIG. 5 shows a highly schematic cross-sectional view of a first example vapor provision system employing induction heating in which aspects of the disclosure can be implemented.

FIG. 5 shows a highly simplified schematic representation of a vapor provision system comprising a cartomizer 40 according to examples of the present disclosure and a power component 20 configured for induction heating. The cartomizer 40 may be as shown in the examples of FIGS. 2, 3 and 4 (although other arrangements are not excluded), and is shown in outline only for simplicity. The cartomizer 40 comprises an atomizer 70 in which the heating is achieved by induction heating so that the heating function is provided by a susceptor (not shown). The atomizer 70 is located in the lower part of the cartomizer 40, surrounded by the enclosure 80, which acts not only to define an aerosol chamber but also to provide a degree of protection for the atomizer 70, which could be relatively vulnerable to damage owing to its cantilevered mounting. The cantilever mounting of the atomizer (70) enables effective induction heating however, because the atomizer 70 can be inserted into the inner space of a coil 90, and in particular, the reservoir is positioned away from the inner space of the work coil 90. Hence, the power component 20 comprises a recess 22 into which the enclosure 80 of the cartomizer 40 is received when the cartomizer 40 is coupled to the power component for use (via a friction fit, a clipping action, a screw thread or a magnetic catch, for example). An induction work coil 90 is located in the power component 20 so as to surround the recess 22, the coil 90 having a longitudinal axis over which the individual turns of the coil extend and a length which substantially matches the length of the susceptor so that the coil 90 and the susceptor overlap when the cartomizer 40 and the power component 20 are joined. In other implementations, the length of the coil may not substantially match the length of the susceptor, e.g. the length of the susceptor may be shorter than the length of the coil, or the length of the susceptor may be longer than the length of the coil. In this way, the susceptor is located within the magnetic field generated by the coil 90. If the items are located so that the separation of the susceptor from the surrounding coil is minimized, the flux experienced by the susceptor is higher and the heating effect made more efficient. However, the separation is set at least in part by the width of aerosol chamber formed by the enclosure 80, which needs to be sized to allow adequate air flow over the atomizer and to avoid liquid droplet entrapment. Hence, these two requirements need to be balanced against one another when determining the sizing and positioning of the various items.

The power component 20 comprises a battery 5 for the supply of electrical power to energize the coil 90 at an appropriate AC frequency. Also, there is included a controller 28 to control the power supply when vapor generation is required, and possibly to provide other control functions for the vapor provision system which are not considered further here. The power component may also include other parts, which are not shown and which are not relevant to the present discussion.

Figure 6:
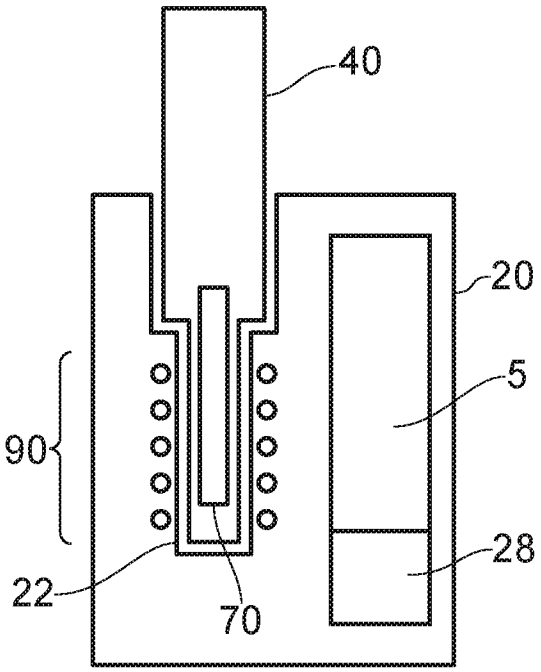
FIG. 6 shows a highly schematic cross-sectional view of a second example vapor provision system employing induction heating in which aspects of the disclosure can be implemented.

The FIG. 5 example is a linearly arranged system, in which the power component 20 and the cartomizer 40 are coupled end-to-end to achieve a pen-like shape. FIG. 6 shows a simplified schematic representation of an alternative design, in which the cartomizer 40 provides a mouthpiece for a more box-like arrangement, in which the battery 5 is disposed in the power component 20 to one side of the cartomizer 40. Other arrangements are also possible.

The atomizer 70 has the form of a porous element with a shape and size defined by an elongate rod-shaped portion (also herein "elongate rod") of porous material, where the porous material is a ceramic material.

Figure 7:
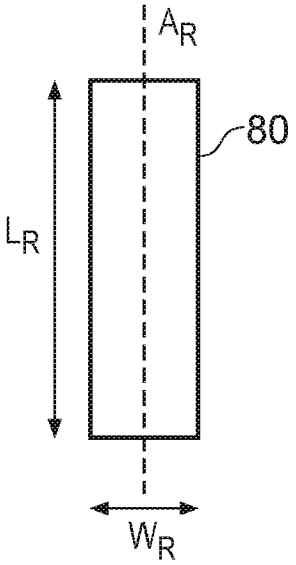
FIG. 7 shows a schematic side view of an example elongate rod suitable to be comprised in a porous element according to aspects of the disclosure.

FIG. 7 shows a schematic side view of an example elongate rod 80. The terms 15 "elongate rod-shaped" and "elongate rod" are intended to convey that the rod 80 has a three-dimensional shape extending along a central longitudinal axis AR for a distance defining a length dimension of the rod 80 which is greater or significantly greater than dimensions of the rod 80 in directions orthogonal to the longitudinal axis. In other words, the transverse dimensions (which may be width, breadth, depth, diameter or major/minor axis, depending on the shape) of the rod 80 are less than its length. For example, the length LR and the width WR (which may a constant value with length, or an average value if the transverse dimensions vary with length or the transverse cross-section of the rod is not circular) may have a ratio in the range of LR:WR=2:1 to 6:1, for example 3:1 or 5:1. For example, the length may be chosen to not be too long compared with the width as this may inhibit liquid from reaching the lower part of the rod in configurations where the atomizer is cantilevered such as in FIGS. 2 to 6, or in other arrangements where liquid is fed to one end of the rod. Further, in such configurations, the width should not be excessive as this will increase the overall dimensions of the cartomizer and the enclosure, which requires a corresponding increase in the dimensions of the work coil. In an example, the length of the rod is 12 mm and the width is 3 mm, giving the ratio LR:WR=4:1. The FIG. 7 example is shown as having a constant width WR, in that the width does not vary with position along the longitudinal axis AR, but this is not essential.

Figure 8:
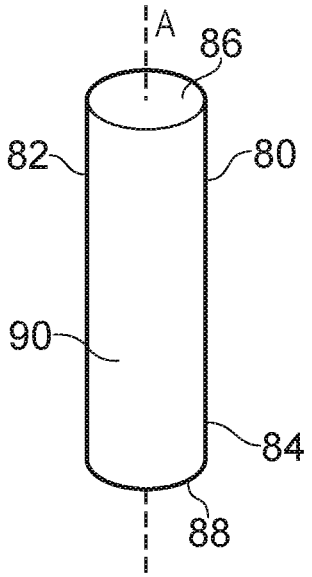
FIG. 8 shows a perspective side view of a further example elongate rod suitable to be comprised in a porous element according to aspects of the disclosure.

FIG. 8 is perspective side view of an example elongate rod 80 having a cylindrical form and hence a circular transverse cross-section. The shape of the elongate rod 80 is defined by its outer surfaces; this is applicable regardless of the cross-sectional shape. The rod 80 has a first end surface or face 86 at a first end 82 of the rod 80, and an opposite, second end surface or face 88 at a second end 84 of the rod 80. The end faces 86, 88 are circular. Typically the first end face 86 and the second end face 88 will be flat, and lie in planes substantially perpendicular to the longitudinal axis AR of the rod 80, but these features are not essential. One or more of the end faces 86, 88 may be curved or otherwise shaped, such as concave or convex. They may lie at an angle to the longitudinal axis AR, and the two end faces 86, 88 may or may not be parallel to one another. For example, in a rod intended for cantilevered mounting by support at its first end, the first end face may be concave or other have an inwardly formed depression or other surface feature in order to direct the flow of incoming liquid from the reservoir into a central or core region of the rod to improve infiltration of the liquid into the porous structure of the rod material.

One or more side walls, side surfaces or side faces 90 extend between the first and second end faces 86, 88. In the FIG. 8 example of a cylindrical rod 80, there is only one, curved, side face 90 which extends continuously around the perimeter of the rod 80. A cylindrical rod may be useful for efficient induction heating, since the rod can be positioned coaxially inside a cylindrical work coil so as to be evenly spaced from the coil on all sides so that the induced heating is even. However, other shapes are not excluded. For example, the cross-sectional shape (that is, the shape of the rod in a plane orthogonal to the longitudinal axis, which is also the shape of the end faces 86, 88 if the cross-sectional shape is non-varying) may be oval, which again gives just one continuous and curved side face. Alternatively, the rod may comprise a prism, with the end faces and cross-section comprising a triangle, a square, a rectangle, a pentagon, a hexagon, or higher orders of polygon. The polygon may be regular or irregular.

Figure 9:
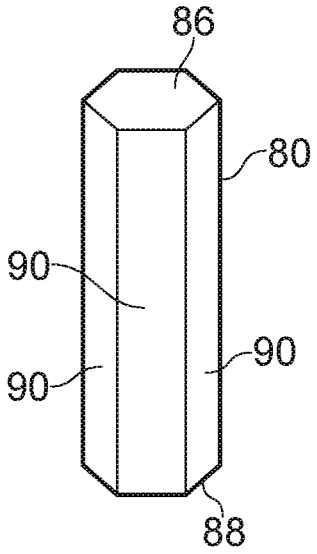
FIG. 9 shows a perspective side view of another example elongate rod suitable to be comprised in a porous element according to aspects of the disclosure.

FIG. 9 shows a perspective side view of an example elongate rod having a hexagonal transverse cross-section. Accordingly, the rod 80 has six side faces 90, adjacent to one another around the perimeter of the rod 80. Similarly, a triangular prism rod will have three adjacent side faces, a square or rectangular prism will have four adjacent side faces, a pentagonal prism will have five adjacent side faces, and so on. The porous element atomizer will be described in more detail hereafter in the context of the cylindrical rod example, for the sake of simplicity. However, all features are equally applicable to other shapes of rod. Accordingly, where a cylindrical rod has one side wall 30 only, this should be understood as applying also to rods with multiple side faces, so that references to "side face" include "side faces", and any rod has at least one side face, or one or more side faces.

A second feature of the porous element is a coating of metal which is applied over part of the outer surface of the elongate rod. In particular, the metal coating is applied to at least part of the side face(s) or at least one of the side faces. As a first example, the metal coating is applied for the purpose of acting as a susceptor for induction heating. Accordingly, when the porous element is placed inside an operating induction work coil, a temperature increase is effected within the metal, which allows the transfer of heat energy to liquid held in the porous structure of the rod material for vapor generation.

Figure 10:
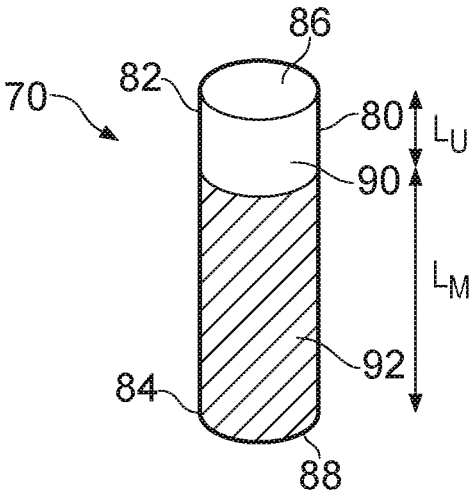
FIG. 10 shows a perspective side view of an example porous element according to aspects of the disclosure.

FIG. 10 shows a perspective side view of an example porous element. The porous element (which in this case can be considered to be an atomizer 70 since it comprises a porous/wicking element in conjunction with a heating element) comprises a cylindrical elongate rod 80 of porous ceramic, and a coating of metal 92. The metal coating 92 is applied continuously around the side wall 90 of the rod 80 for part of the length of the side wall 90 which extends from the second end face 88 and hence over the second end 84 of the rod 80 but stops prior to the first end 82 of the rod 80. Hence, the first end 82 is not covered by the metal coating 92. This arrangement is designed so that when the porous element 70 is mounted at its first end in a cantilevered fashion as in the examples of FIGS. 2 to 6, the susceptor provided by the metal coating is appropriately positioned for surrounding with the induction work coil as in FIGS. 5 and 6. The length LM of the metal coating 92 along the longitudinal dimension of the rod 80 can be substantially matched to the length of the work coil, or may differ, as described above. The purpose of leaving the first end 82 of the rod without a coating of metal is to reduce, limit or avoid heating of the material of the rod 80 in the vicinity of the first end 82. This reduces the transfer of heat energy to the liquid stored in the reservoir of the cartomizer, which is in contact with the first end surface 86 of the rod 80. Also, it reduces any unwanted effects of temperature increase for the component used to support the porous element 70, such as the flow directing member 60 into which the first end of the porous element is inserted. The supporting element can have reduced heat resistant properties, so the choice of material for the supporting element is broader.

The length Lu of the uncoated portion at the first end 80, as a proportion of the whole length LR of the rod, might be in the range of 10% to 50%, for example, such as 10% to 30% or 20% to 30% or 10% to 20%.

In order to provide efficient transfer of heat from the metal coating to the porous ceramic, the metal coating can extend continuously around the perimeter surface of the rod 80, in other words continuously around all of the one or more side faces 90, in addition to extending continuously in the longitudinal direction. This provides the maximum surface area for the susceptor and hence the maximum heating effect. However, this is not essential, and the metal coating may be discontinuous around the perimeter and/or discontinuous along the length, for example applied in stripes. This might be used to provide a tailored heating profile, for example.

Also, the metal coating 92 may be applied to the one or more side faces 90 (continuously or discontinuously) over the full length of the rod 80, so that the first end 82 of the rod 80 has a covering of metal, and is not uncoated. Any supporting element that holds the first end 82 of the rod 80 should be able to withstand the temperature increase that will occur by the conduction of heat from the part of the metal coating inside the magnetic field of the induction work coil (which is therefore operable as the susceptor) to the part of the metal coating outside the work coil and in contact with the supporting element.

Note that in the FIG. 10 example, the first end face 86 of the rod 80 is not coated with the metal layer 92. This is to allow the ingress of liquid from the reservoir. A partial metal coating of the end face 86 is not excluded, but will reduce the rate of liquid uptake by the porous ceramic so may be considered undesirable. In other cases, this may be used deliberately to decrease the liquid uptake rate. Depending on the manner in which the rod 80 is supported or held, a part of the side faces 90 may also be in contact with the liquid in the reservoir, and so may also affect liquid uptake.

Accordingly, the metal coating may have one or more gaps, openings, perforations or apertures therein. The gaps may control liquid intake, in the case of a metal coating over the first end face 86, or may control heat conduction.

Figure 11:
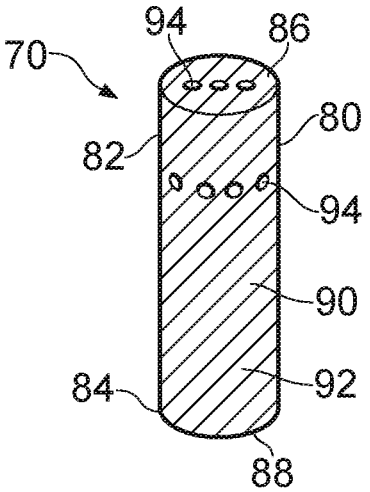
FIG. 11 shows a perspective side view of a further example porous element according to aspects of the disclosure.

FIG. 11 shows a perspective side view of a porous element 70, in which the metal coating 92 extends over the whole length of the side face 90 of the rod 80, from the first end 82 to the second end 84. A row of holes or windows 94 in the metal coating 92 is arranged in a ring around the perimeter proximate to the first end 82 in order to reduce heat transfer from the susceptor part of the metal coating 92 (proximate the second end 84 and also over the central part of the length of the rod 80) to the part at the first end 82 where the rod 80 will be held and supported. Also, holes 94 are provided in a metal coating which is applied over the first end face 86 in order to tailor the rate at which liquid will be absorbed into the porous ceramic. Other arrangements of holes, openings or other discontinuities in the metal layer are not excluded.

Also, openings in the metal layer may be provided more generally over the extent of the metal layer in order to facilitate the escape of vapor from the porous ceramic. This is not essential, however. It has been found that for the thickness of metal which is appropriate for use as a susceptor, as discussed further below, and using methods for applying the metal which also are discussed further below, vapor is able to escape from the porous ceramic even through a metal layer which is intended to be continuous, in other words which does not have any openings explicitly designed into it. The mechanism for this is not well understood, but it is likely that on a microscopic scale, the metal layer is formed with some inherent discontinuities, perhaps owing to the surface shape and features of the porous ceramic, which are sufficient to allow the passage of vapor.

In any configuration, the second end face 88 may be provided with a metal coating or may be uncoated. A coating is not necessary to contribute to the susceptor function; sufficient heating can be obtained by metal on the side face or faces only. However, a coating may be useful in order to help retain liquid within the porous ceramic material. This aspect of the metal layer is discussed further below.

For effective use as a susceptor, the coating of metal applied to the one or more side faces over at least part of the length of the rod has a thickness of at least 1 μm, such as a thickness of at least 5 μm. Generally, the thickness need not exceed about 20 μm. Hence, the susceptor metal layer may have a thickness in the range of 5 μm to 20 μm, for example 5 μm to 15 μm, or 7 μm to 15 μm, or 10 μm to 15 μm, or 7 μm to 12 μm, or 9 μm to 10 μm. A thicker coating provides a larger volume and hence a larger mass of metal for heating by induction, so that more heat energy can be delivered to vaporize liquid absorbed in the porous ceramic. However, similar amounts of heating can be achieved with different thicknesses of metal by appropriate choice of the frequency of the alternating current intended to be applied to the induction work coil to generate the alternating magnetic field. A higher frequency can achieve the same degree of heating in a thinner metal layer than a lower frequency used with a thicker metal layer. Therefore, a higher induction frequency might be selected in order to reduce the amount of metal which is needed. As an example, a metal layer with a thickness of between 9 μm and 10 μm has been found to be practical for use with an induction frequency in the range of 2 MHz to 3 MHz.

The relationship between effectiveness of heating and the thickness of the metal layer can be used to provide a varying heating profile over the length of the atomizer from a simple induction work coil that operates at a single fixed frequency in order to generate an alternating magnetic field of substantially the same strength and frequency at all locations. Mother words, all parts of the metal layer within the work coil experience the same magnetic field. In such an environment, if the metal layer on the side face(s) has different thicknesses at different positions, different temperatures can be achieved in different parts of the atomizer. This can be used to concentrate the heating effect in a region or zone where it is most required, such as in the middle portion and the unsupported second end portion of the rod, and reduce or minimize heating at the supported first end, for example.

In reality, the magnetic field of an induction work coil tends to be weaker at and towards the ends of the coil, so the thickness profile and corresponding heating profile can be used to exaggerate or amplify this effect, with a thicker metal layer being used over a central or intermediate portion of the atomizer to coincide with the higher magnetic field strength from the center part of the induction coil. Conversely, a thicker metal layer might be used to compensate for a weaker magnetic field. For example, a thicker metal layer might be applied over the second end of the rod to enable more heating where the magnetic field strength might be less if the end of the coil is aligned with or in the vicinity of the unsupported end of the atomizer.

Figure 12:
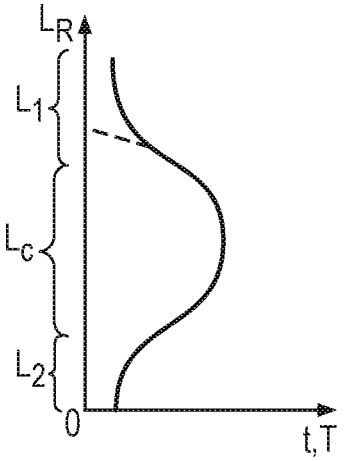
FIG. 12 shows a first example thickness profile of a metal coating of a porous element according to aspects of the disclosure, as a plot of thickness against length position along the porous element.

FIG. 12 shows a first example of a varying thickness profile for the metal coating. The vertical axis shows the position along the length LR of the rod, starting from O at the second end, so that higher values of LR correspond to positions closer to the first end, namely the end of the atomizer which is intended to be supported and to receive liquid from the reservoir. The second end is a length portion L2, the first end is a length portion L1, and the intermediate part of the atomizer is a central length portion Le. The horizontal axis shows the thickness t of the metal coating, and correspondingly the temperature or heating effect T, which will be greater for a thicker amount of metal.

The profile has a small value of t over the first end and over the second end (thin 10 metal coating), and a larger value of t (thicker metal coating) over the intermediate portion. Thus, heating will be greater in the intermediate portion of the atomizer. Reduced heating over the first end can reduce or minimize the transfer of heat to the supporting element in which the atomizer is mounted and/or the liquid stored in the reservoir. Reduced heating over the second end may be appropriate, for example if the amount of liquid that reaches this part of the porous ceramic remote from the reservoir is relatively small so that vapor generation from the second end is less. The profile may alternatively have a zero value oft over the first end, as shown by the dotted line in FIG. 12. This indicates that the first end is uncoated with metal, as in the example of FIG. 10. In another alternative, t may have different values over the first end and the second end, both less than the thickness of the thicker metal layer in the central region.

Figure 13:
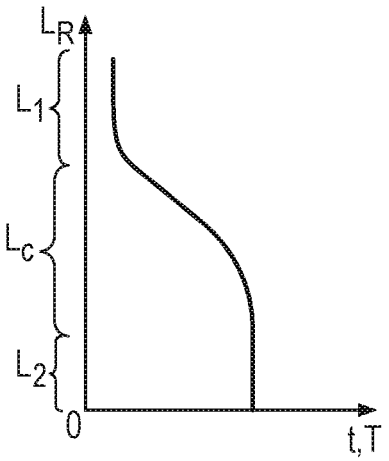
FIG. 13 shows a second example thickness profile of a metal coating of a porous element according to aspects of the disclosure, as a plot of thickness against length position along the porous element.

FIG. 13 shows a second example of a varying thickness profile for the metal coating. This profile has a small (or zero) value oft over the first end to minimize heat delivery to the atomizer support element and the reservoir, and a larger value oft over the intermediate portion and the second end, coinciding with the magnetic field provided by the induction work coil.

These example profiles have a smooth variation of t over LR. This is not a requirement, however, and the profile could instead be stepped between different values oft. Other profile shapes are not excluded. In general, the metal layer has a thickness profile which varies with length along the rod, in order to generate a heating or temperature profile under induction heating conditions which also varies with length along the rod.

Within a profile, the thickness t varies between a maximum value tmax and a minimum value tmin. The value oft can vary within the ranges discussed above, such as between 5 μm and 20 μm; this is particularly applicable to the part or parts of the metal layer that are intended as the susceptor. Typically this is the second end and the central part, or primarily the central part. As mentioned with regard to FIG. 12, the profile may include lengths in which tmin is zero, in other words where no metal coating is applied, and no susceptor function is provided. This is particularly relevant in the context of the first end.

As an alternative to this, the metal coating may be applied in some regions so as to have a value tmin which is greater than zero, but insufficient to give an appreciable or worthwhile susceptor function, in that little or minimal heating will be achieved within an alternating magnetic field. Thickness values less than 5 μm might be employed for this purpose. For example, tmin might be about 1 μm, or about 2 μm, or about 3 μm, or about 0.5 μm.

A function of this thinner amount of metal coating is to provide an encapsulation effect, to reduce or prevent leakage of liquid outwardly from the porous ceramic. This helps to retain liquid within the atomizer for vapor generation, and reduce the escape of free liquid into the aerosol chamber. The metal coating has an effect of sealing the outer surface of the porous ceramic rod so that the pores in the ceramic are closed and liquid cannot escape outwardly, or is at least inhibited from so doing (although vapor can escape, as mentioned above). Also, the metal coating has been observed to have a hydrophobic property so that liquid is repelled away from the immediate vicinity of the surface of the rod.

Accordingly, some parts of the metal coating on the side face or faces may have a thickness less than 5 μm for a main purpose of providing an encapsulating layer, and some parts of the metal coating on the side face or faces may have a thickness of 5 μm or above, such as in the range of 5 μm to 20 μm, for a main purpose of acting as a susceptor.

Further in this regard, the second end face may be provided with a metal coating of a thickness suitable to provide the encapsulating effect, that is, below 5 μm. This inhibits the leakage of liquid out through the second end face, which might otherwise be promoted by the effect of gravity since the second end of the rod will be the lowest part of a cantilevered atomizer when a vapor provision system such as the examples described above is held in atypical and common vertical orientation.

For an encapsulating layer, apertures or openings may be provided in the metal coating for purposes such as inhibiting heat conduction and promoting vapor escape. If the apertures are small, such as sized in order that surface tension effects in liquid held in the rod inhibit the outward flow of liquid through the apertures, the presence of the apertures need not be detrimental to the encapsulating effect.

Note that while the porous element disclosed herein has been described thus far as being for use as an atomizer which is mounted in a cantilevered fashion, this is not necessary, and the porous element may be configured for mounting in other arrangements, with the metal layer disposed over the relevant surface regions of the porous ceramic rod to act as a susceptor, and optionally to provide some encapsulation to control leakage.

In some examples, the porous element is not intended for use on its own as an atomizer, in that the metal layer is not intended to act as a susceptor, and the rod of porous ceramic material is intended to act as a porous wicking component for an atomizer in which the heater is a separate component located proximate the rod in order to supply heat to liquid absorbed by the ceramic material. In such a case, the metal coating applied to one or more faces of the porous ceramic rod is a thin layer only, with a thickness below 5 μm at all points. The thickness might vary with position on the rod's surface, however, such as being thicker in regions that will generally be lower when the porous element is installed in a vapor provision system, to counteract leakage promoted by the downward movement of liquid under gravity. A metal layer configured in this way provides the reduced leakage, encapsulation effect described above while allowing the ready escape of vapor from the ceramic material when the porous element is heated. Some part of the porous ceramic rod should remain exposed in order to allow liquid to enter, however. This may be in the form of larger uncoated areas, such as one or both end faces or end portions, and/or in the form of smaller apertures or openings within a coated area.

Figure 14:
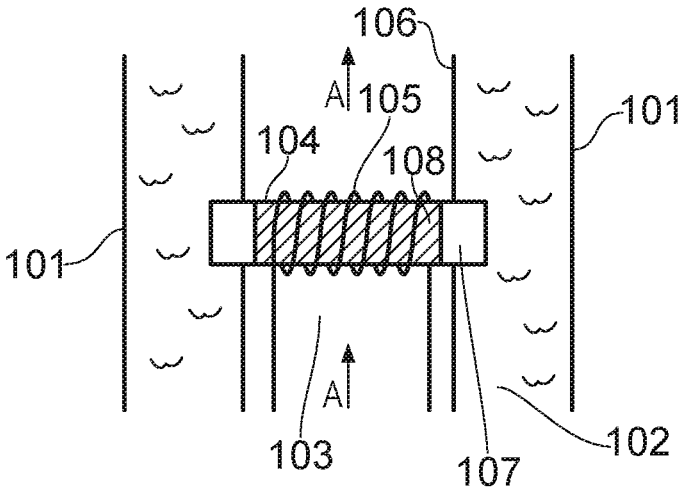
FIG. 14 shows a schematic side view of an example aerosol source comprising a porous element according to alternative aspects of the disclosure.

FIG. 14 shows a schematic representation of an example aerosol source for a vapor provision system comprising a porous element configured in this way. The aerosol source comprises an annular reservoir 101 containing liquid 102 to be vaporized. The central space within the annular reservoir 101 defines an aerosol chamber 103 for vapor generation, within an airflow channel that passes through the overall vapor provision system for the passage of air A in order to collect vapor and deliver aerosol for user inhalation to an outlet of the airflow channel (not shown). An atomizer is provided which comprises a wicking element 104 disposed within the windings of a resistive electrical heating element 105 formed from metallic wire in the shape of a coil. The wicking element 104 is disposed transversely across the airflow channel with each of its two ends protruding through openings in an inner wall 106 of the reservoir 101. The wicking element 104 is a porous element comprising a rod 107 of porous ceramic with a coating of metal 108 on its side surface(s) as described herein. The metal coating 108 is applied to a central portion of the rod 107 only, and both end portions and end faces of the rod 107 are uncoated. Hence, these end portions are able to absorb liquid from inside the reservoir, and the liquid is then drawn through the porous structure by capillary action to the vicinity of the heating element 105. When current is passed through the heating element 105 it heats up so that heat is delivered to the liquid in the porous ceramic, causing. The vapor is able to escape through the metal coating 108, to be picked up by the air flow along the airflow channel. The metal coating acts as an encapsulation layer to reduce the chance of free liquid escaping from the wicking element 104 into the aerosol chamber 103. Hence, it may have a thickness of less than 5 μm, such as 1 μm or 0.5 μm.

The FIG. 14 configuration is merely one example, and porous ceramic wicking elements provided with metal coatings for leakage reduction may be used in other atomizer arrangements. For example, electrical heating elements or heaters configured other than in a coil shape or other than as a conductive wire might be used, disposed externally to the wicking element, or embedded inside it. The wicking element and the reservoir might be arranged in a different spatial configuration in order for liquid to be absorbed by the wicking element, also.

As an alternative, the metal coating may be used directly as a resistive heating element. This is compatible with a thin metal layer for encapsulation purposes since a lower thickness provides a higher electrical resistance so resistive heating is more effective. Also, the overall area of the metal coating can be selected to tailor the resistance, for example by choosing the width of the ceramic rod and choosing the length of the coated area. In general, the metal thickness can be about 10 μm or less, and can usefully be lower such as less than 5 μm or 1 μm or less. In some situations, a thinner metal coating may be considered most appropriate in order to enhance the electrical resistance. Uncoated portions can be provided at an or each end of the ceramic rod in order to allow the ingress of liquid. This may be by an arrangement such as in FIG. 14 where the ends of the porous element extend into an annular reservoir, for example.

Figure 15:
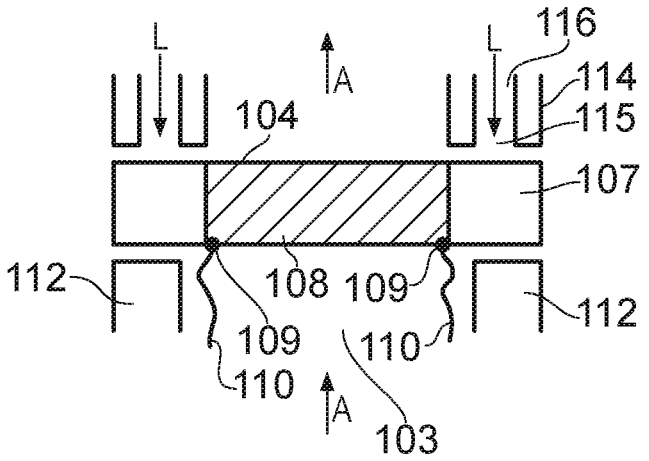
FIG. 15 shows a schematic side view of a further example aerosol source comprising a porous element according to alternative aspects of the disclosure.

FIG. 15 shows a schematic representation of an example aerosol source for a vapor provision system comprising a porous element having a metal layer configured to operate as a heating element, for the purpose of aerosol generation. As in the FIG. 14 example, a porous (wicking) element 104 comprises a rod 107 of porous ceramic with a coating of metal 108 on its side surfaces as described herein. The metal coating 108 is applied to the central portion of the rod 107 only, and both end portions of the rod 107 are uncoated. The rod 107 is supported at its end portions so that its longitudinal axis arranged across an aerosol chamber 103, transverse to a direction of the flow of air A through the aerosol chamber 103 in order to collect vapor and deliver aerosol for user inhalation.

Merely as an example configuration, a support or mount 112 is provided which holds each uncoated end portion of the rod 107, while each uncoated end portion is similarly held from above by a liquid-supplying mount 114. The mounts 112, 114 may clamp the end portions between them, for example, or may configured as a unitary component with a hole into which an end portion of the rod 107 is inserted for holding. The liquid supplying mounts 114 each have a liquid feed channel 116 running therethrough which connect with a source of liquid or other aerosol forming substrate (for example a reservoir, not shown) at one end, and are open to the uncoated rod end portions at a second end via a liquid outlet 115. In this way, liquid L can be delivered to the porous rod material, where it is absorbed, and carried by wicking or capillary action to the central portion of the rod 107, adjacent the metal coating 108.

In order to enable the metal coating 109 to operate as a heating element, it is provided with an electrical contact or connection 109 at or near each edge (in other words, spaced apart with respect to the length of the rod 107) each of which secures (such as by a soldered connection) a conductive lead or wire 110 which are connected (directly or indirectly) to an electrical power supply such as a battery (not shown). This arrangement allows electrical current to be passed through the resistive metal coating 109 so that heat is generated for the purpose of vaporizing liquid held in the rod 107. In this example, the lead 110 are carried inside the aerosol chamber 103, but they might alternatively be positioned externally to the aerosol chamber (outside the boundary formed by the mounts 112), or may be located in conduits inside the mounts 112, for example.

The FIGS. 14 and 15 arrangements are merely examples, and the various features may be embodied differently as will be apparent to the skilled person. For example, the wire coil heater of FIG. 14 may be used in conjunction with the liquid feed arrangement of FIG. 15, or the use of the metal coating directly as a resistive heater shown in FIG. 15 may be used with the annular reservoir of FIG. 14. Other liquid storage and flow configurations, and other arrangements for the direct supply of electrical current to the metal coating are also possible and not excluded. Also, for both direct and indirect resistive heating, the metal coating may be disposed differently on the porous rod from the central portion arrangement in FIGS. 14 and 15. For example, a smaller uncoated area, or an area comprising small apertures in the coating, may be provided for the ingress of liquid, in place of the entire uncoated ends shown in FIGS. 14 and 15.

Figure 16A:
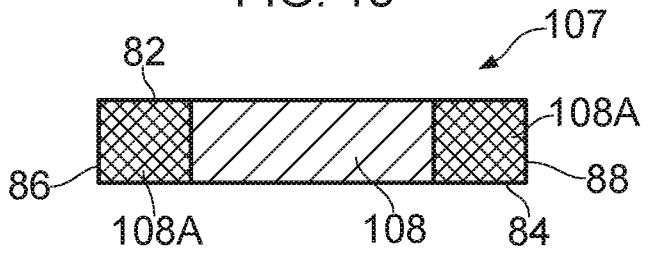
FIG. 16A shows a schematic side view of another example porous element according to an alternative aspect of the disclosure.

FIG. 16A shows a schematic representation of a further example of a porous element configured with a metal coating for use as a resistive electric heating element. The porous element comprises a rod 107 of porous ceramic, as before. Over the length Le of its central portion, the rod 107 is provided with a metal coating 108, typically with a thickness of 10 μm or less and intended to be operable as a resistive electrical heating element when electrical current is passed through it. To increase the current path length, and produce heating along a large proportion of the length of the rod, the path is arranged to extend lengthwise along the rod 107; this is enabled by allowing external electrical connections to be made at the two opposite ends of the rod. The two end portions of the rod 107, over a length $L_1$ at the first end 82 of the rod 107 and over a similar or equal length $L_2$ at the second end 84 of the rod 107, are provided with a metal coating 108A of an increased thickness. The increased thickness might be fabricated by a same method as is used to apply the central portion of the metal coating (such as a deposition technique, discussed in more detail below). Alternatively, a metal coating of a substantially uniform thickness corresponding to the desired thickness for the central portion might be applied over all or most of the full length of the rod 107, and a different technique might be employed to increase the thickness of the coating at the end portions 82, 84. A different metal can be used for the coating at the end portions, or the same metal can be used throughout.

These regions of increased thickness are intended as electrical contacts for the central thinner metal coating, and can enable an electrical connection across the central metal coating to be made more easily. A soldered join with a wire or lead might be easier to fabricate onto the thicker metal layer, for example. Alternatively, the rod may be mounted in a vapor provision system in such a way as to bring part of the thicker metal portions into contact with conductive contacts, so that no physical joint is needed. This can allow a user to replace the rod if required, for example. The contacts might be configured in the manner of amounting for a fuse or a cylindrical battery, for example, utilizing metal clips and/or biased elements to make a close contact with the thickly coated portions of the rod.

Figure 16B:
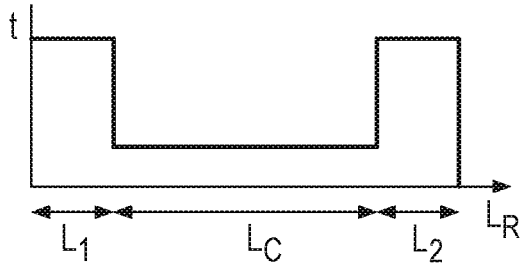
FIG. 16B shows a thickness profile of a metal coating of the porous element of FIG. 16A.

FIG. 16B shows a graph of the thickness t of the metal coating 108 as it varies with length LR along the rod. As can be seen, the end portions $L_1$ and $L_2$ have a much greater thickness of metal coating than the central portion Le, which is thin so as provide high electrical resistance and therefore efficient electrical heating, and also to allow the escape of vapor from the interior ceramic material. While in this example, the thickness profile is configured with step changes between the thicker and thinner parts, this is not necessary, and a more gradual change may be used if such is more appropriate for the metal coating technique which is employed to make the coated porous element.

Within an arrangement such as the FIG. 16A example, it is necessary to leave one or more uncoated areas to allow liquid to be absorbed into the ceramic material from an external source. Conveniently, the end faces 86, 88 of the rod 107 may be left without coating. Alternatively, one or more gaps may be left in the metal coating for the ingress of liquid, either in thicker end portions (electrical contact portions), or the thinner central portion (electrical heater portion).

The metal layer can be applied to the surface of the porous ceramic by any of various 25 deposition techniques which are able to deposit metals at a layer thickness according to the ranges described above. Examples of suitable techniques include physical vapor deposition techniques, chemical vapor deposition techniques, and sputtering techniques. Variations in thickness, uncoated areas and surfaces, and holes/apertures/gaps can be achieved using known methods such as masking and photolithography techniques. The skilled person will be aware of appropriate methods for applying a micrometer scale thickness of metal of constant or varying thickness to part or all of the surface of a portion of a porous ceramic material, including those mentioned and others, such as any suitable lamination technique.

Various metals can be used for the metal coating. A useful example is nichrome, being any of a selection of alloys of nickel and chrome (and optionally other elements, such as iron). This is a relatively inert metallic material, so can stand up well to exposure to the liquid and vapor in a vapor generation system without degradation or interaction that could contaminate the vapor. For example, a nickel-chrome alloy in the proportion of 80:20 could be used. Other examples include cobalt, nickel and gold. However, the metal coating is not limited to these materials, and may comprise other metals, including elemental metals and alloys.

Various materials may be used as the porous ceramic. Examples include alumina, cordierite, mullite and silica carbide. Alumina is suitable as it is a particularly chemically neutral material. However, the porous ceramic is not limited to these materials, and others may be used instead.

In conclusion, in order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other inventions not presently claimed, but which may be claimed in future.

The invention claimed is:

1. A porous element for a vapor provision system, comprising:

an elongate rod of porous ceramic material having a first end face, a second end face, and one or more side faces extending between the first end face and the second end face and defining a length of the rod; and a coating of metal applied to at least one of the one or more side faces over at least part of the length of the rod and wherein the coating of material is also applied to the second end face.

2. The porous element according to claim 1, wherein the coating of metal is applied to every side face of the one or more side faces.

3. The porous element according to claim 2, wherein the coating of metal extends continuously around the one or more side faces.

4. The porous element according to claim 1, wherein a portion of each of the one or more side faces adjacent the first end face has no coating of metal, to provide an uncoated end portion of the rod.

5. The porous element according to claim 4, wherein the uncoated end portion occupies between 10% and 50% of the length of the rod.

6. The porous element according to claim 1, wherein the coating of metal is applied to the one or more side faces substantially up to the second end face.

7. The porous element according to claim 1, wherein the one or more side faces comprise a single side face, the rod being a circular or elliptical cylinder.

8. The porous element according claim 1, wherein the coating of metal is applied by sputtering, chemical vapor deposition or physical vapor deposition.

9. The porous element according to claim 1, wherein the metal comprises nickel, gold, cobalt or a nickel chrome alloy.

10. The porous element according to claim 1, wherein the coating of metal has a thickness in a range of 1 μm to 50 μm.

11. The porous element according to claim 10, wherein at least part of the coating of metal has a thickness less than 5 μm to provide an encapsulating layer on the rod for inhibiting liquid leakage.

12. The porous element according to claim 10, wherein at least part of the coating of metal has a thickness of 5 μm or greater to provide a susceptor for heating the rod by induction heating.

13. The porous element according to claim 12, wherein the coating of metal has a thickness in a range of 5 μm to 20 μm.

14. The porous element according claim 1, wherein the coating of metal has a thickness that varies with position along the length of rod.

15. The porous element according to claim 14, wherein the coating of metal on the at least one of the one or more side faces has a first thickness near the first end face and a second thickness greater than the first thickness near the second end face.

16. The porous element according to claim 14, wherein the coating of metal on the at least one of the one or more side faces has a first thickness near the first end face, a second thickness near the second end face, and a third thickness greater than the first thickness and the second thickness at an intermediate portion of the at least one of the one or more side faces.

17. The porous element according to claim 15, wherein the second thickness of the coating of metal is in a range of 5 μm to 20 μm.

18. The porous element according to claim 15, wherein at least the first thickness of the coating of metal is less than 5 μm.

19. The porous element according to claim 1, wherein the coating of metal is operable as a susceptor for heating the rod by induction heating and is configured to provide a heating profile that varies along the length of the rod when used with an induction work coil operable at a spatially constant alternating current frequency.

20. The porous element according to claim 19, further comprising electrical contacts for the coating of metal by which an electric current can be passed through the coating of metal such that the coating of metal is operable as a resistive electrical heater for heating the rod.

21. The porous element according to claim 20, wherein the electrical contacts comprise coatings of metal of a greater thickness at or towards end portions of the rod, the coating of metal over an intermediate portion of the rod having a thickness less than the greater thickness to be operable as the resistive electrical heater.

22. The porous element according to claim 20, wherein the coating of metal operable as the resistive electrical heater has a thickness of 10 μm or less.

23. The porous element according to claim 1, wherein the coating of metal is provided with one or more apertures within which the rod is uncoated.

24. An aerosol source for a vapor provision system comprising the porous element according to claim 1, and a reservoir for holding aerosolizable substrate material to be delivered to the porous element for vaporization.

25. A cartomizer for a vapor provision system comprising the porous element according to claim 1.

26. A vapor provision system comprising the porous element according to claim 1 and an electrical power source.

27. The vapor provision system according to claim 26, configured such that the electrical power source provides electrical power to enable operation of the coating of metal as a heating element.

* * * * *